US006745069B2

(12) United States Patent
Nissilået al.

(10) Patent No.: US 6,745,069 B2
(45) Date of Patent: Jun. 1, 2004

(54) ELECTRONIC WRIST-WORN DEVICE AND METHOD OF CONTROLLING THE SAME

(75) Inventors: Seppo Nissilå, Oulu (FI); Pertti Puolakanaho, Oulu (FI)

(73) Assignee: Polar Electro Oy, Kempele (FI)

( * ) Notice: Subject to any disclaimer, the term of this patent is extended or adjusted under 35 U.S.C. 154(b) by 435 days.

(21) Appl. No.: 09/861,904

(22) Filed: May 21, 2001

(65) Prior Publication Data

US 2002/0013535 A1 Jan. 31, 2002

(30) Foreign Application Priority Data

Jun. 8, 2000 (FI) ..... 20001369

(51) Int. Cl.[7] ..... G04B 37/12; G04B 47/06

(52) U.S. Cl. ..... 600/523; 600/503; 482/3; 368/278; 368/281

(58) Field of Search ..... 482/1, 3; 600/502–503, 600/508, 509, 519–521, 523; 368/277, 278, 281

(56) References Cited

U.S. PATENT DOCUMENTS

| | | | | | |
|---|---|---|---|---|---|
| 3,823,551 | A | | 7/1974 | Riehl | |
| 3,978,849 | A | * | 9/1976 | Geneen | 600/503 |
| 4,168,607 | A | * | 9/1979 | Friedman | 368/283 |
| 4,248,244 | A | * | 2/1981 | Charnitski et al. | 600/519 |
| 4,625,733 | A | | 12/1986 | Saynajakangas | |
| 4,776,045 | A | * | 10/1988 | Mysliwiec et al. | 2/426 |
| 5,757,731 | A | * | 5/1998 | Rosenberg | 368/242 |
| 5,769,755 | A | | 6/1998 | Henry et al. | |
| 6,314,058 | B1 | * | 11/2001 | Lee | 368/10 |
| 6,493,652 | B1 | * | 12/2002 | Ohlenbusch et al. | 702/160 |
| 6,525,997 | B1 | * | 2/2003 | Narayanaswami et al. | 368/223 |
| 2002/0151810 | A1 | * | 10/2002 | Wong et al. | 600/520 |

FOREIGN PATENT DOCUMENTS

| | | | | |
|---|---|---|---|---|
| CH | 616801 | * | 4/1980 | A61B/5/02 |
| EP | 0584919 | * | 2/1994 | |
| JP | 07294674 | | 11/1995 | |
| WO | WO 87/05229 | * | 9/1987 | A63B/69/00 |

* cited by examiner

*Primary Examiner*—Kennedy Schaetzle
*Assistant Examiner*—Kristen Droesch
(74) *Attorney, Agent, or Firm*—Hoffmann & Baron, LLP

(57) ABSTRACT

The invention relates to an electronic wrist-worn device, such as a heart rate monitor, a sportsman's watch or a diving computer, and its control method. The outside of the casing of the device comprises a bottom surface to be placed against the wrist, a top surface (304), and a side surface (308) between the bottom surface and the top surface (304). On the top surface (304) of the casing there is provided a first display (306) connected to the control electronics. On the side surface (308) of the casing there is provided a second display (400, 402, 404; 406) connected to the control electronics. The best viewing angle of the first display (306) and the best viewing angle of the second display (400, 402, 404; 406) are at an angle of 60 to 120 degrees with respect to each other.

42 Claims, 4 Drawing Sheets

ELECTRONIC WRIST-WORN DEVICE AND METHOD OF CONTROLLING THE SAME

FIELD OF THE INVENTION

The invention relates to an electronic wrist-worn device, for example to a measuring device, such as a heart rate monitor, used for measuring non-invasively a signal from a human body or to a similar electronic device used during physical exercise in particular. These devices include diverse sportsman's watches and diving computers, which may also comprise an altimeter, a depth gauge or an electronic compass.

BRIEF DESCRIPTION OF THE RELATED ART

A device carried on the wrist usually comprises one or more displays on the same plane. The outside of the casing of the device comprises a bottom surface to be placed against the wrist and a top surface on the casing side facing away from the bottom surface. Inside the casing are the control electronics of the device. The display or displays are arranged to the top surface of the casing and connected to the control electronics.

The display of a device attached to the wrist is usually read by turning the arm in the longitudinal direction thereof, in addition to which the arm must usually be bent. A problem encountered here is that in some special circumstances the display on the top surface of the casing is difficult to read. During swimming, for example, the required movement of the arm disturbs the correct pace of the arm strokes.

Japanese patent publication 07294674 (Citizen Watch Co. Ltd.) teaches a wrist watch comprising two displays, an analog and a digital one. The displays are on the same plane, similarly as in ordinary watches, only the analog display has been turned 90 degrees to the right from the ordinary position. The arrangement of the displays described in the publication allows a person to check the time without bending the arm, for example when driving a car. However, the described solution does not allow the display to be read during physical exercise without turning the arm.

SUMMARY OF THE INVENTION

It is an object of the invention to provide an improved electronic wrist-worn device and an improved method for controlling an electronic wrist-worn device. One aspect of the invention is an electronic wrist-worn device. Another aspect of the invention is a method for controlling an electronic wrist-worn device.

An underlying idea of the invention is that the device is provided with two displays. A first display is positioned on the top surface of the casing of the device. A second display is positioned on the side surface of the casing, between the top and bottom surfaces of the device. The best viewing angle of the second display is directed such that the display can also be read during physical exercise without arm movements disturbing the exercise too much. Correct positioning of the second display and the optimal viewing angle thereby produced allows to eliminate at least either the need to bend the arm at the elbow or the need to turn the arm when the second display of the device is to be read.

The second display is preferably implemented either as a liquid crystal display or as a LED display. An advantage of the liquid crystal display is that a greater amount of more detailed information can be displayed, when necessary. On the other hand, an advantage of the LED display is that in some circumstances the information displayed may be easier to see than information on a liquid crystal display.

BRIEF DESCRIPTION OF THE DRAWINGS

In the following, the preferred embodiments of the invention will be described by way of example with reference to the accompanying drawings, in which.

DETAILED DESCRIPTION OF THE PREFERRED EMBODIMENTS

Figure 3:
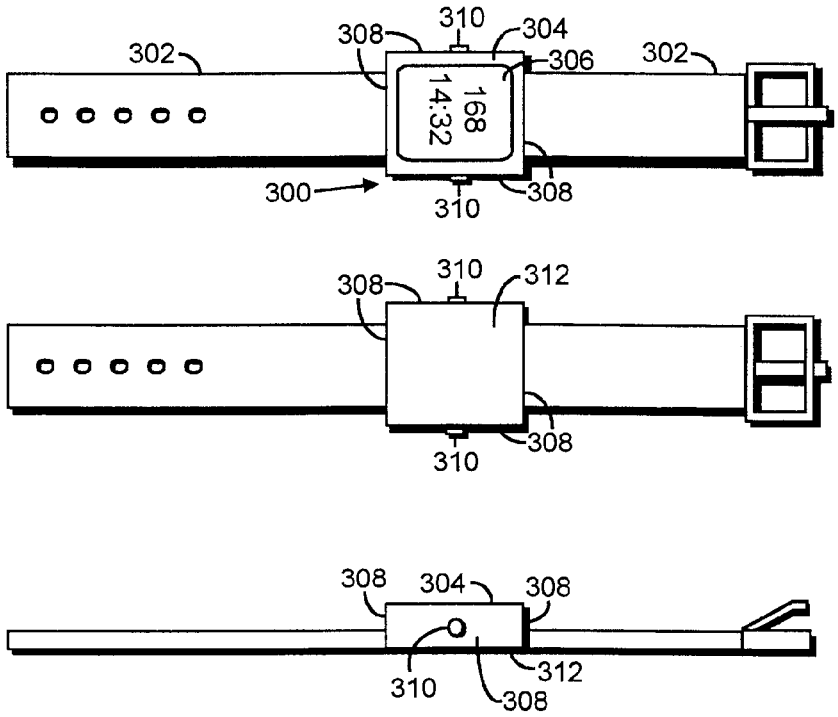
FIG. 3 shows top, bottom and side views of the structure of an electronic wrist-worn device.
Figure 4A:
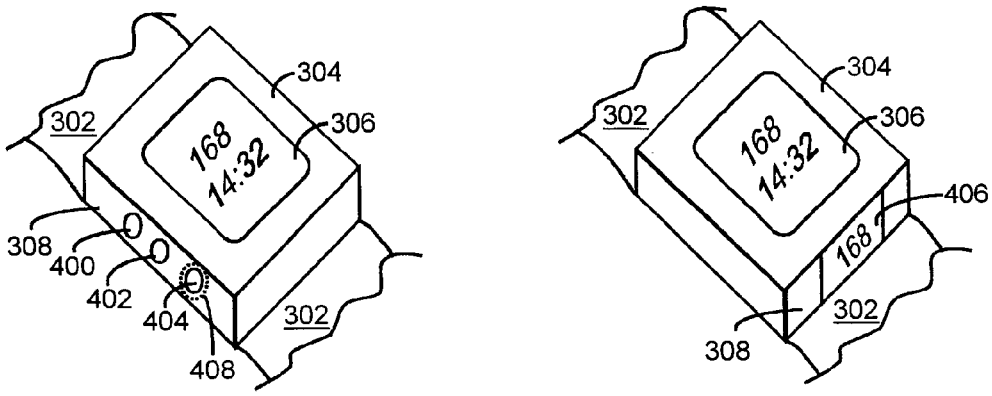
FIG. 4A illustrates the positioning of a second display to the electronic wrist-worn device.

FIG. 3 provides top, bottom and side views of an electronic device to be carried on the wrist. FIG. 4A shows the device as seen diagonally from above. A casing 300 of the device protects its sensitive control electronics. Since the control electronics of the device must be accessible for servicing, its casing 300 is usually made of at least two detachable pieces. The device is usually water-proof, i.e. the casing 300 parts are provided with seals between them. The casing 300 is attached to a wristband 302 to allow the device to be fastened around the user's wrist. The wristband 302 is usually made of one or two parts attached to the casing 300 of the device.

The outside of the casing 300 of the device comprises a bottom surface 312, a top surface 304 on the casing side facing away from the bottom surface 312, and a side surface 308 between the bottom surface and the top surface 304. In FIG. 3, as well as in FIGS. 4A and 4B, the device is shown to have a simple rectangular form. The design of the outside 300 of the casing of the device may vary in many ways; it may be made as a piece having regular or irregular geometric shapes. The shape of the device may be determined by its purpose of use or the esthetic impression aimed at. However, the casing of the device can always be shown to comprise a bottom surface 312, top surface 304 and side surface 308, although their shape may be irregular and the borders between them may not be completely clear. In other words, the term 'surface' does not refer to a specific structural part of the casing 300, but to an area or portion of the outer surface of the casing 300.

The top surface 304 of the casing is provided with a first display 306 connected to the control electronics 624 of the device. In our example the device is a heart rate monitor showing the user's heart rate "168" and the time "14:32" on the display 306.

As already mentioned, an electronic wrist-worn device may be a measuring device for measuring various variables relating to physical exercise and used for forming information to be displayed to the user. Variables such as exercise time and/or speed and/or distance travelled and/or intensity may be applied. In addition, when the physical exercise consists of walking or running, the variable may be the pace and when swimming is concerned, the variable may be stroke frequency. Further, the user's heart rate measured with the device may used as a variable.

Usually devices to be used during physical exercise can be provided with different alarm limits. Hence the information displayed may contain elements indicating whether the measured variable is within a target zone and/or above the target zone and/or below it.

The first display 306 of the device in the example is a liquid crystal display, but in principle it may be implemented using any prior art display technology suitable for the purpose.

The side surface 308 of the casing of the device is provided with a second display connected to the control electronics of the device. The second display in the device on the left in FIG. 4A is a LED display comprising at least one LED (Light Emitting Diode) 400, 402, 404, whereas the second display of the device on the right is a liquid crystal display 406. Similarly as the first display, the second display can also be implemented using any display technology suitable for the purpose. When a display is to be selected, the requirements set by the purpose of use of the device with regard to for example the size, brightness, power consumption, durability and water-tightness of the display should be taken into account. Even though FIG. 4A only illustrates devices comprising one second display 400, 402, 404 or 406, it is apparent that a device may be provided with more than one second display. For example, by combining the left-hand side device in FIG. 4A with the right-hand side device, a useful device with two different kinds of second displays 400, 402, 404; 406 is produced. In other words, several second displays based on the same technology or on different technologies may be provided in one and the same device. It is also apparent that, when necessary, the second displays 400, 402, 404; 406 may be placed on other side surfaces 308 than the second displays 400, 402, 404; 406 in FIG. 4A.

The device on the left in FIG. 4A comprises three LEDs 400, 402, 404, but it is apparent that there may also be two LEDs or one, or there may be more than three LEDs. Information can be displayed with the LEDs 400, 402, 404 at least in two different ways, i.e. by using their colours or their blinking frequency.

The second display of a preferred embodiment comprises LEDs 400, 402, 404 of different colours, such as yellow and/or green and/or red LEDs 400, 402, 404. These LEDs can be used to build a more or less complete set of "traffic lights". If the second display comprises a yellow LED 402, it may be used to indicate that the measured variable is below the target zone. If the second display comprises a green LED 402, it indicates that the measured variable is within the target zone. If the second display comprises a red LED 402, it indicates that the measured variable is above the target zone. In a heart rate monitor, for example, heart rate limits such as 140 and 160 may be used. Consequently, at a heart rate between 140 and 160, the green LED would be illuminated, at a heart rate below 140, the yellow LED would be illuminated, and at a heart rate exceeding 160, the red LED would be illuminated. LEDs of other colours may naturally be used as well. In addition, by varying the number of LEDs illuminated simultaneously and by changing the colour combinations, different kinds of information can be displayed.

The blinking frequency of the LEDs can be used to display information. Low-frequency blinking of at least one LED 400, 402, 404 indicates the measured variable to be below the target zone. The non-illumination of the LED 400, 402, 404 indicates that the measured variable is within the target zone. High-frequency blinking of at least one LED 400, 402, 404 in turn indicates that the measured variable is above the target zone. A plural number of LEDs blinking simultaneously at the same or at a different frequency could, at least in theory, be used for communicating information to the user. Similarly, by using different colours and frequencies, different combinations could be obtained. For example, the device could comprise only one red LED: when the variable is within the target zone, the LED is not illuminated, whereas slow blinking of the LED shows the variable to be below the target zone, and rapid blinking shows that it is above the target zone. Those skilled in the art, i.e. experts designing user interfaces for devices to be carried on the wrist, will find it apparent that the on the basis of the described examples and by testing prototypes on test persons, the disclosed principles can be applied to create a method suitable for each particular purpose to allow the second display to be implemented as a LED display.

The second, liquid crystal display on the right-hand side device in FIG. 4A is used for displaying a single piece of information, i.e. the user's current heart rate "168". In a preferred embodiment, the second display 406 is a touch screen, whereby it may serve not only as an information display but also as a user interface element connected to the control electronics. It may thus replace a push-button 310 or a turn-button 310 connected to the device's user interface. This allows the surface area of the outside of the casing to be used as efficiently as possible. A similar advantage is gained with the device on the left in FIG. 4A in which the second display is implemented by means of LEDs 400, 402, 404 of which at least one LED 400, 402, 404 is integrated with at least one push-button 310 or turn-button 310 of the device's user interface.

In another preferred embodiment, the second display 400, 402, 404; 406 comprises an optic 408 attached in front of the second display 400, 402, 404; 406 to magnify the information displayed or to direct the information to a specific viewing angle. The optic 408 is implemented as a light-refracting and/or focusing and/or magnifying optical device, such as a lens or a mirror.

Figure 1:
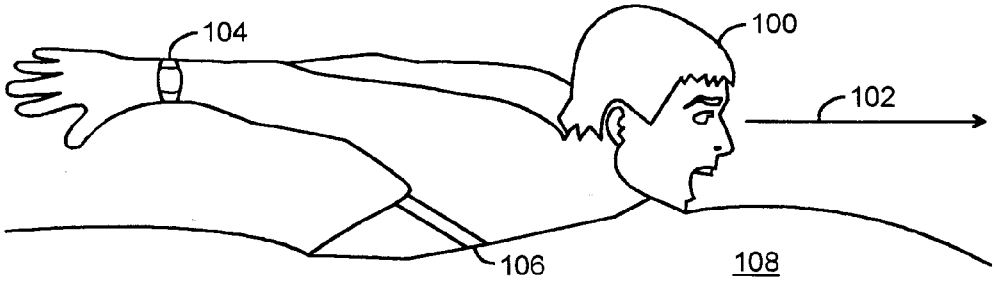
FIG. 1 illustrates swimming exercise in which a heart rate monitor is used.
Figure 2:
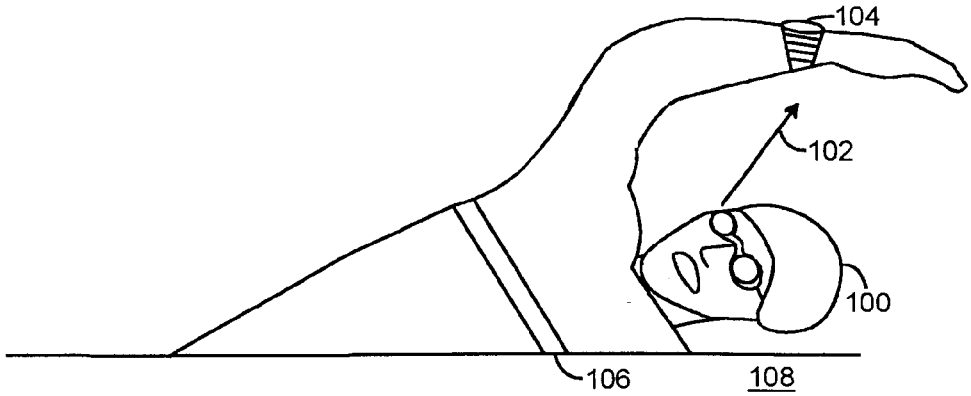
FIG. 2 illustrates another example of swimming exercise in which a heart rate monitor is used.

FIG. 1 and 2 further illustrate a problem related to the use of an electronic wrist-worn device. FIG. 1 shows a swimmer doing butterfly strokes. During the brief moment when the swimmer's upper body is above the surface of the water 108, the swimmer's 100 eyes are directed 102 straight ahead. The swimmer 100 is using a heart rate monitor 104, and there is an electrode transmitter belt around his chest to measure his heart rate. A problem here is that it is impossible to read the first display 306 of the heart rate monitor 104 during the swimming without the swimming being thereby disturbed. It is also difficult to read the first display 306 under the water. FIG. 2 shows a swimmer 100 who is wearing swim goggles, and although they facilitate seeing under water, the position of the arm would, nevertheless, have to be changed when the first display 306 is to be read and thus the efficiency of the arm movement would be impaired. The swimmer 100 in FIG. 2 is doing freestyle where the movement of the arm is different than in butterfly strokes, but the problem remains the same: information on the first display 306 is difficult to read without the swimming being disturbed. The same goes with breaststroke and backstroke. However, the second display 400, 402, 404; 406 can be read without the swimming being disturbed, because the viewing angle of the second display 400, 402, 404; 406 is different than that of the first display 306. The LED display 400, 402, 404 is preferably used as the second display in devices to be worn during swimming because light and/or colour and/or the blinking frequency of light can be easily discerned, even though water and the splashing of it partly impair the vision.

Figure 4B:
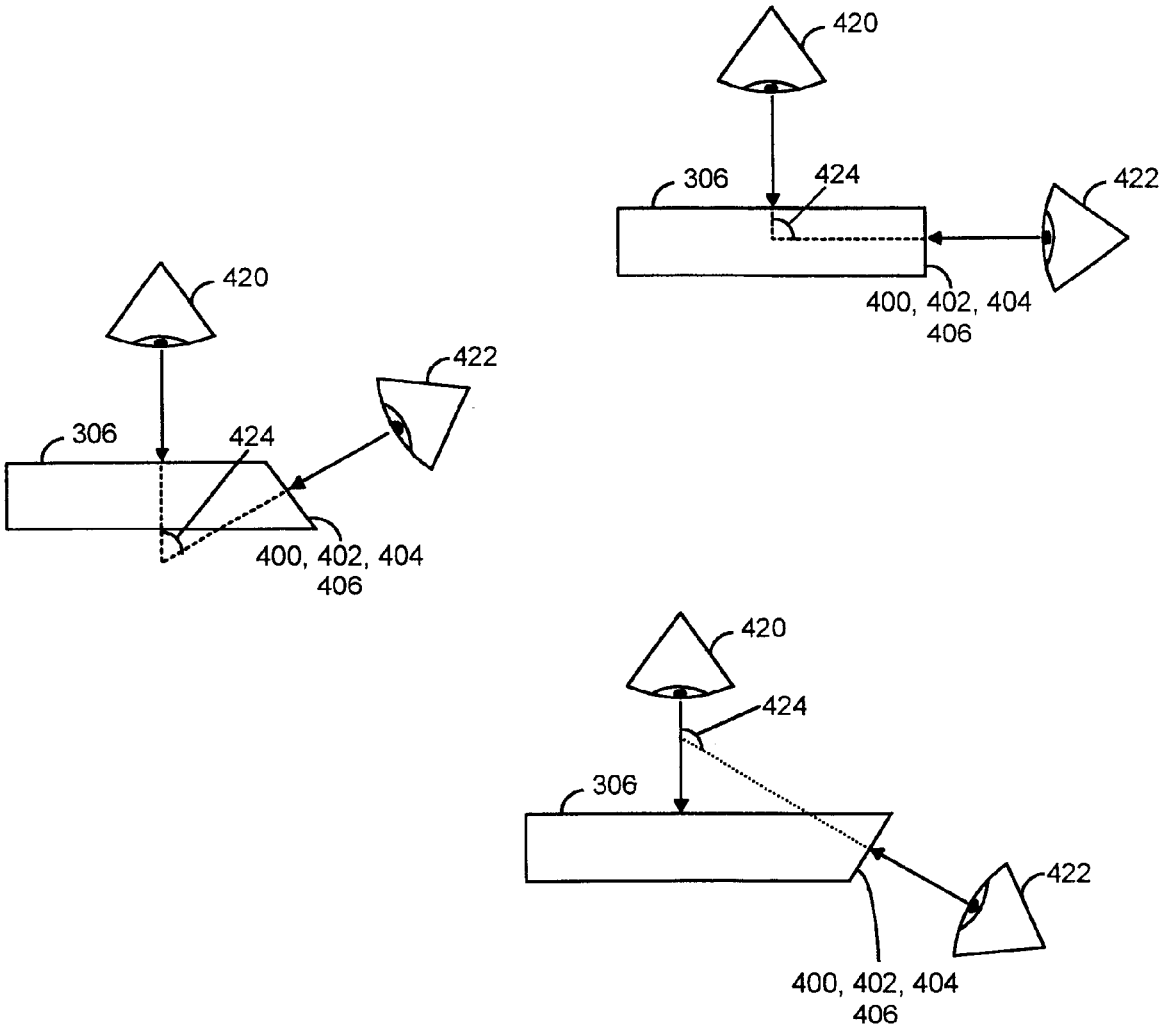
FIG. 4B illustrates the viewing angles of the displays of the electronic wrist-worn device.

FIG. 4B further illustrates the significance of the positioning of the best display viewing angles on the device. The first display 306 is usually viewed best from a viewing angle 420 directly perpendicular to the display. The second display 400, 402, 404; 406 is in turn viewed best from a viewing angle 422 perpendicular to the side of the device. The best viewing angle 420 of the first display 306 and that of the second display 400, 402, 404; 406 thus form a substantially straight angle 424 with respect to each other, as shown in FIG. 4B. The best viewing angle 420 of the first display 306 and the best viewing angle 422 of the second display 400, 402, 404; 406 can form an angle 424 of 60–120 degrees with respect to each other. Of the situations in FIG. 4B, the one in the middle illustrates an angle of 60 degrees and the one below an angle of 120 degrees.

U.S. Pat. No. 4,625,733, Säynäjäkangas, teaches a wireless and continuous heart rate measuring concept employing a transmitter attached to a user's chest for ECG-accurate measuring of the user's heart rate and for telemetric transfer of the heart rate data by means of magnetic coils to a heart rate receiver attached to the user's wrist.

Figure 5:
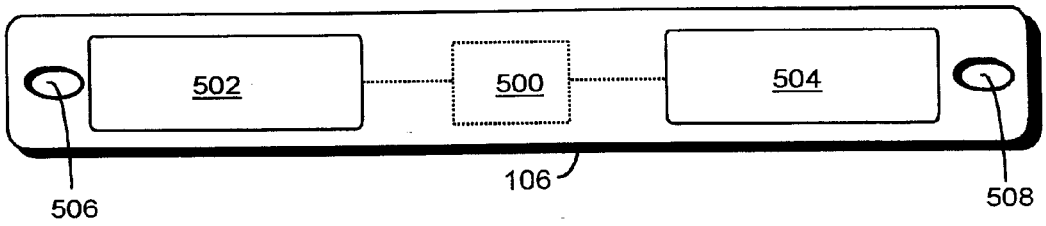
FIG. 5 illustrates an electrode transmitter belt of a heart rate monitor.

In the following, an electrode transmitter belt 106 of a heart rate monitor will be described in greater detail with reference to FIG. 5. The electrode belt 106 comprises holes 506, 508 to which an elastic band fastening the electrode belt 106 around the chest is secured, usually with a male/female-type joint. Electrodes 502, 504 measuring the heart rate are connected with wires to an electronics unit 500 where the heart rate information obtained from the electrodes 502, 504 is processed and transmitted to a heart rate monitor 104 carried on the wrist.

Figure 6:
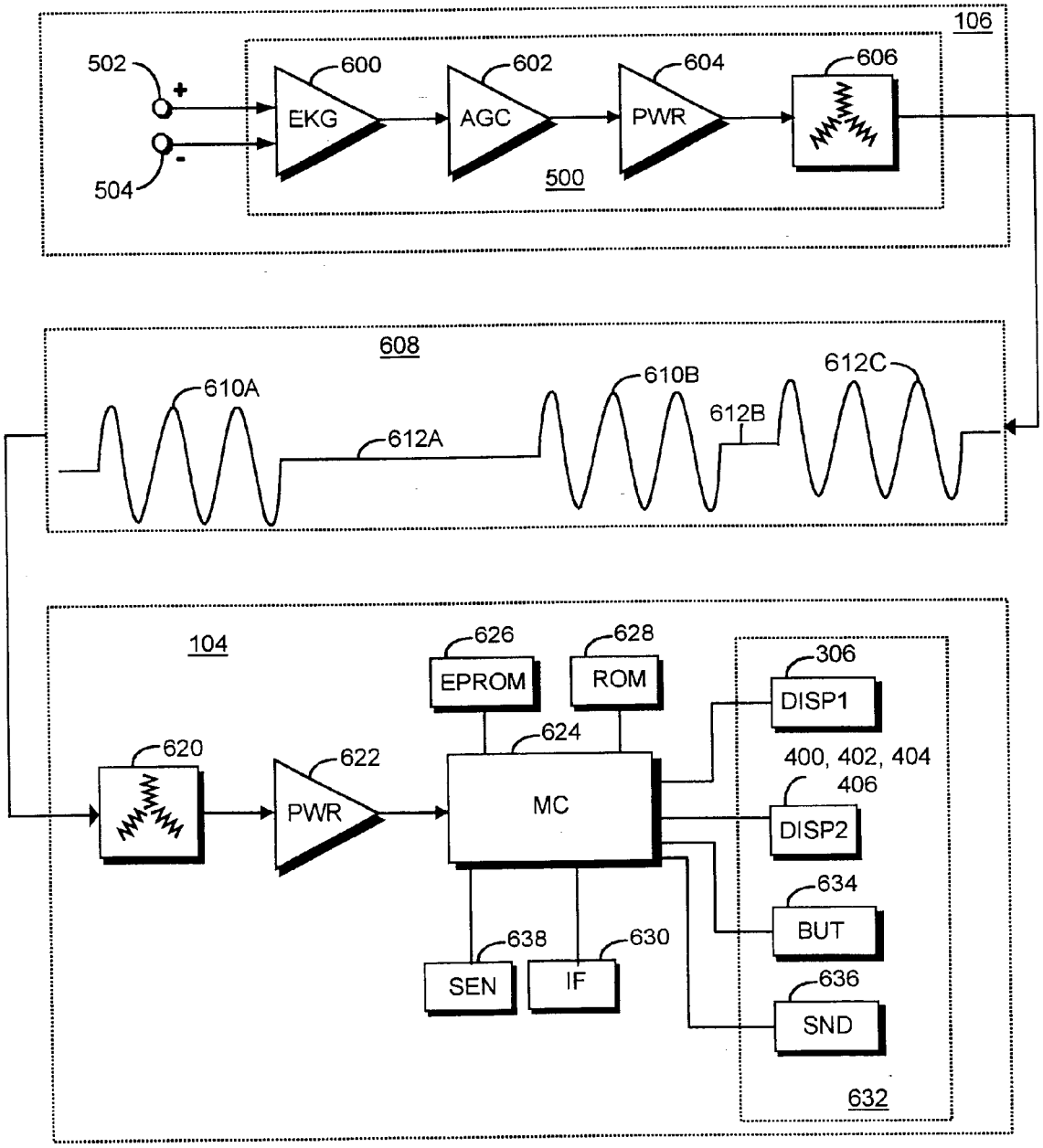
FIG. 6 illustrates the structure of a heart rate monitor transmitter belt attached to the chest and that of a wrist-worn heart rate monitor.

FIG. 6 illustrates the structure of the transmitter electrode belt 106 and that of the heart rate monitor 104 carried on the wrist. 'Heart rate monitor' refers to the entity formed by the transmitter electrode belt 106 and the receiver 104. The heart rate monitor can also be implemented by integrating the functions of the transmitter electrode belt 106 and the receiver 104 into a single device to be attached to the wrist. It is apparent to a person skilled in the art that the electrode belt 106 and the receiver 104 may also comprise other parts than those shown in FIG. 6, although it is not relevant to describe them herein. FIG. 6 shows the essential parts of the transmitter electrode belt 106 on the top, a sample of heart rate information 608 to be transmitted in the middle, and the heart rate monitor 104 at the bottom. The electronics unit 500 of the transmitter electrode belt 106 receives heart rate information from the electrodes 502, 504 which measure one or more heart rate information parameters. From the electrodes 502, 504, the signal is transmitted to an ECG preamplifier 600 and from there through an AGC amplifier (Automatic Gain Control) 602 and a power amplifier 604 further to a transmitter 606. The transmitter 606 is preferably implemented as a coil which sends the heart rate information 608 inductively to the receiver 104.

One heartbeat is represented for example by one 5 kHz burst 610A or a group 610A, 610B, 610C of several bursts. Intervals 612A, 612B between the bursts 610A, 610B, 610C may be of an equal duration, or their duration may vary. The information may be transmitted inductively, or, alternatively, it may be sent optically or through a wire, for example. In a preferred embodiment, the receiver 104 comprises a receiver coil 620 from which the received signal is transmitted through a signal receiver 622 to control electronics 624 controlling and coordinating the operation of the different parts of the heart rate monitor 104. The heart rate monitor 104 preferably also comprises memory (EPROM= Erasable Programmable Read Only Memory) 626 for storing heart rate information, and memory (ROM=Read Only Memory) 628 for storing the computer software of the heart rate monitor 104. The control electronics 624 and its memory are preferably implemented using a general-purpose microprocessor provided with the necessary system and application software, although diverse hardware implementations are also possible, such as a circuit built of separate logic components, or one or more ASICs (Application Specific Integrated Circuit). Matters affecting the solution adopted for implementing the control electronics 624 include at least requirements set to the size and power consumption of the device, its manufacturing costs and the production volumes.

The heart rate monitor 104 often comprises an interface 630 between the heart rate monitor 104 and the external world. Through the interface 630, information stored in the heart rate monitor can be transferred for further processing to a personal computer, for example. In addition, the interface 630 can be used for updating the software of the heart rate monitor. For this purpose, special mechanisms are needed. For example, the ROM memory 628 in which the software is stored must be changed to a memory type capable of receiving writing as well.

The user interface 632 of the heart rate monitor comprises the first display 306, second display 400, 402, 404; 406, push-buttons and/or turn-buttons 634 for making choices and for activating and stopping functions, as well as means 636 for producing sound, such as sound signals. Sound signals can also be used for example for giving an alarm if a variable to be measured is below or above the control limits, or to provide other information of interest to the user.

The transmitter belt 106 and the heart rate monitor 104 both comprise a power source, not shown in FIG. 6. The power source of the transmitter belt 106 is usually provided by means of batteries. The heart rate monitor 104 may employ a battery, other prior art means of generating power, for example a solar cell producing current from a light source, or a generator producing current based on kinetic energy.

In a preferred embodiment the control electronics 624 of the device are connected to at least one push-button 310 or turn-button 310, the control electronics 624 receiving a signal from the push-button 310 or turn-button 310 on the basis of which signal the control electronics 624 select the information to be shown on the second display 400, 402, 404; 406. The information may consists of the variables relating to physical exercise described above, for example.

In another preferred embodiment the device further comprises a sensor 638 connected to the control electronics 624, the control electronics 624 using the control data received from the sensor 638 to control the on- and off-states of the first display 306 and/or the second display 400, 402, 404; 406. The sensor 638 of the preferred embodiment detects whether the device is in the water or out of it, i.e. in the air. When the device is in the water, the control electronics 624 set the second display 400, 402, 404; 406 to the on-state. At the same time, the first display 306 can be switched off to save power.

Figure 7:
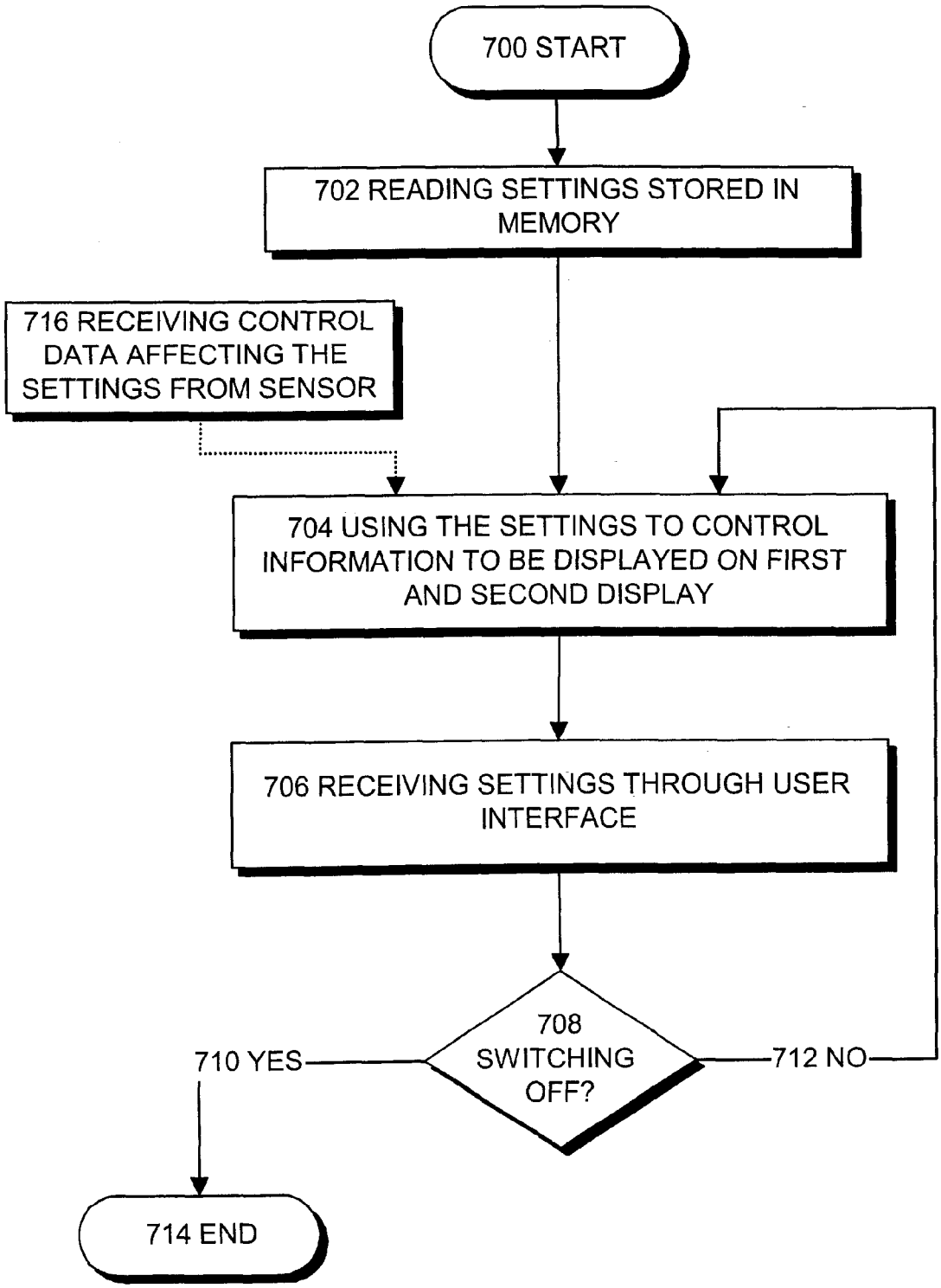
FIG. 7 is a flow diagram illustrating a method for controlling the electronic wrist-worn device.

The flow diagram in FIG. 7 illustrates measures carried out in the method for controlling an electronic wrist-worn device. The execution of the method begins at block 700 where the measures for switching on the device are carried out in practice. The devices are often continuously switched on, and therefore the measures to switch on the device are carried out practically only after a battery change.

In block 702, stored settings guiding the operation of the device are read into memory 626 or 628. Default setting values which the user may possibly modify are usually stored at the plant.

In block 704, the settings are used to control the first display 306 connected to the control electronics and positioned to the electronic device on the outside top surface of its casing facing away from the bottom surface of the casing to be placed against the wrist, and to control the second display 400, 402, 404; 406 connected to the control electronics and positioned to the side surface between the bottom surface and the top surface. With regard to the viewing angles of the displays, their implementation and the information to be displayed, the matters and preferred embodiments disclosed above are valid.

In block 706, settings made by the user and transmitted through the user interface 632 connected to the control electronics 624 are received.

In block 708, the switching off of the device is tested. If the device is switched off (provided that it is possible), the routine proceeds to block 714, as indicated by arrow 710, where measures for switching off the device are carried out. Otherwise the routine returns to block 704, as indicated by arrow 712.

Block 716 illustrates the operation of a stimulus. In a stimulus mechanism, the sensor connected to the control electronics provide control data to be used by the control electronics for controlling the on- and off-sates of the first display and/or the second display, as described above. The sensor may be for example one that detects a contact with water, i.e. whether the device is in the water or out of it. The sensor comprises two electrodes, the impedance/resistance between the electrodes allowing to detect whether the device is in the water or out of it. In the water, the contact is typically lower than 10 000 ohms, for example. When the sensor has detected the device to be in the water, the second display 400, 402, 404; 406 is kept switched on by the control electronics 624 for ten minutes, for example, from the last contact through the water detected by the sensor. This provides an advantage in that the second display 400, 402, 404; 406 is not switched off for example if the monitor is out of the water for a moment during the swimming because of a movement taking place in the air to return the arm to the front before a new underwater stroke begins.

Although the invention is described above with reference to an example according to the accompanying drawings, it is apparent that the invention is not restricted to it, but may vary in many ways within the inventive idea disclosed in the claims.

What is claimed is:

1. A method for controlling an electronic wrist-worn device, the method comprising:

reading settings stored in a memory;

controlling, on the basis of the settings, a first display connected to control electronics and positioned on a top surface of a casing of the wrist-worn device opposing a bottom surface of the casing to be placed against the wrist, and a second display connected to control electronics and positioned on a side surface between the bottom surface and the top surface, the control electronics of the device using control data received from a sensor connected to the control electronics to control on-and off-states of at least one of the first display and the second display the sensor detecting whether the device is in the water or in the air.

2. A method according to claim 1, wherein the best viewing angle of the first display and the best viewing angle of the second display are at an angle of 60 to 120 degrees with respect to each other.

3. A method according to claim 2 wherein the angle is substantially a straight angle.

4. A method according to claim 1, wherein settings made by a user are received through a user interface connected to the device's control electronics.

5. A method according to claim 1, wherein the second display shows information that relates to a variable measured during physical exercise performed by the user of the device.

6. A method according to claim 5, wherein the variable is at least one of exercise time, speed, distance traveled, and performance.

7. A method according to claim 5, wherein the variable relating to physical exercise which is walking or running is the pace.

8. A method according to claim 5, wherein the variable relating to physical exercise which is swimming is the stroke frequency.

9. A method according to claim 5, wherein the variable is the user's heart rate measured with the device.

10. A method according to claim 5, wherein the information comprises an indication of whether the measured variable is at least one of within the target zone, above the target zone, and below target zone.

11. A method according to claim 10, wherein the second display comprises a yellow LED to inform that the measured variable is below the target zone.

12. A method according to claim 10, wherein the second display comprises a green LED to inform that the measured variable is within the target zone.

13. A method according to claim 10, wherein the second display comprises a red LED to inform that the measured variable is above the target zone.

14. A method according to claim 10, wherein the second display comprises at least one LED the low-frequency blinking of which indicates that the measured variable is below the target zone.

15. A method according to claim 10, wherein the second display comprises at least one LED the non-illumination of which indicates that the measured variable is within the target zone.

16. A method according to claim 10, wherein the second display comprises at least one LED the high-frequency blinking of which indicates that the measured variable is above the target zone.

17. A method according to claim 1, wherein the control electronics controls the second display to the on-state when the device is in the water.

18. An electronic wrist-worn device comprising a casing of the device, the outside of the casing comprising a bottom surface to be placed against the wrist, a top surface opposing the bottom surface, and a side surface between the bottom surface and the top surface;

control electronics of the device inside the casing;

a first display connected to the control electronics and positioned on the top surface of the casing;

a second display connected to the control electronics and positioned on the side surface of the casing, and a sensor connected to the control electronics, the control electronics using control data received from the sensor to control on-and off-states of at least one of the first display and the second display, the sensor detecting whether the device is in the water or in the air.

19. A device according to claim 18, wherein the best viewing angle of the first display and the best viewing angle of the second display are at an angle of 60 to 120 degrees with respect to each other.

20. A device according to 19, wherein the angle is substantially a straight angle.

21. A device according to claim 18, wherein the second display is a liquid crystal display.

22. A device according to claim 18, wherein the second display is a touch screen.

23. A device according to claim 18, wherein the second display is a LED display comprising at least one LED.

24. A device according to claim 23, wherein the second display comprises LEDs of different colours.

25. A device according to claim 24, wherein the second display comprises at least one of a yellow, green, and red LED.

26. A device according to claim 23, wherein information is displayed using the blinking frequency of the LED.

27. A device according to claim 18, wherein the second display is integrated with at least one push-button or turn-button.

28. A device according to claim 18, wherein an optic is attached in front of the second display to magnify information displayed on the display or to direct it to a specific viewing angle.

29. A device according to claim 18, wherein at least one push-button or turn-button is connected to the control electronics of the device, the control electronics receiving from the push-button or turn-button a signal on the basis of which the control electronics selects the information to be displayed on the second display.

30. A device according to claim 18, wherein the second display shows information that relates to a variable measured during physical exercise performed by the user of the device.

31. A device according to claim 30, wherein the variable is at least one of exercise time, speed, distance traveled, and intensity.

32. A device according to claim 30, wherein the variable relating to physical exercise which is walking or running is a pace.

33. A device according to claim 30, wherein the variable relating to physical exercise which is swimming is the stroke frequency.

34. A device according to claim 30, wherein the variable is the user's heart rate measured with the device.

35. A device according to claim 30, wherein the information comprises an indication of whether the measured variable is at least one of within the target zone, above the target zone, and below the target zone.

36. A device according to claim 35, wherein the second display comprises a yellow LED to inform that the measured variable is below the target zone.

37. A device according to claim 35, wherein the second display comprises a green LED to inform that the measured variable is within the target zone.

38. A device according to claim 35, wherein the second display comprises a red LED to inform that the measured variable is above the target zone.

39. A device according to claim 35, wherein the second display comprises at least one LED the low-frequency blinking of which indicates that the measured variable is below the target zone.

40. A device according to claim 35, wherein the second display comprises at least one LED the non-illumination of which indicates that the measured variable is within the target zone.

41. A device according to claim 35, wherein the second display comprises at least one LED the high-frequency blinking of which indicates that the measured variable is above the target zone.

42. A device according to claim 18, wherein the control electronics controls the second display to the on-state when the device is in the water.

* * * * *

UNITED STATES PATENT AND TRADEMARK OFFICE

CERTIFICATE OF CORRECTION

PATENT NO. : 6,745,069 B2
DATED : June 1, 2004
INVENTOR(S) : Nissilä et al.

It is certified that error appears in the above-identified patent and that said Letters Patent is hereby corrected as shown below:

Title page,
Item [12], United States Patent, reads "Nissilået al.", and should read -- Nissilä et al. --; and
Item [75], Inventors, "Seppo Nissilå", and should read -- Seppo Nissilä --.

Signed and Sealed this

Fourteenth Day of September, 2004

JON W. DUDAS
*Director of the United States Patent and Trademark Office*